US007574754B2

(12) United States Patent
Arai

(10) Patent No.: US 7,574,754 B2
(45) Date of Patent: Aug. 18, 2009

(54) HELMET

(76) Inventor: Michio Arai, c/o Arai Helmet, Ltd., 2-12, Azuma-cho, Ohmiya-Ku, Saitama-Shi, Saitama-Ken (JP)

( * ) Notice: Subject to any disclaimer, the term of this patent is extended or adjusted under 35 U.S.C. 154(b) by 266 days.

(21) Appl. No.: 11/144,684

(22) Filed: Jun. 6, 2005

(65) Prior Publication Data

US 2006/0248631 A1 Nov. 9, 2006

(30) Foreign Application Priority Data

Apr. 20, 2005 (JP) ..... 2005-122226

(51) Int. Cl.
*A42B 1/06* (2006.01)

(52) U.S. Cl. ..... 2/410

(58) Field of Classification Search ..... 2/171.3, 2/424, 410, 425, DIG. 1, 6.4, 6.5, 417, 184.5
See application file for complete search history.

(56) References Cited

U.S. PATENT DOCUMENTS

| | | | | |
|---|---|---|---|---|
| 5,086,520 | A * | 2/1992 | Arai | 2/424 |
| 5,157,794 | A * | 10/1992 | Kamata | 2/424 |
| 5,170,510 | A * | 12/1992 | Nava | 2/414 |
| 5,345,614 | A * | 9/1994 | Tanaka | 2/425 |
| 5,575,018 | A | 11/1996 | Rothrock | |
| 5,996,128 | A | 12/1999 | Yanagihara | |
| 6,263,513 | B1 * | 7/2001 | Murakami | 2/171.3 |
| 6,347,412 | B1 | 2/2002 | Dorman | |
| 6,910,228 | B2 * | 6/2005 | Tanaka | 2/424 |
| 2005/0066416 | A1 * | 3/2005 | Ma | 2/171.3 |
| 2006/0248631 | A1 * | 11/2006 | Arai | 2/424 |

FOREIGN PATENT DOCUMENTS

| | | | |
|---|---|---|---|
| EP | 320622 | A2 * | 6/1989 |
| EP | 1062884 | | 12/2000 |
| EP | 1396200 | | 3/2004 |
| GB | 2336519 | | 10/1999 |
| JP | 08291422 | A * | 11/1996 |
| JP | 3050720 | | 5/1998 |
| JP | 10245712 | | 9/1998 |
| JP | 2004084098 | | 3/2004 |
| JP | 8199419 | | 8/2006 |

OTHER PUBLICATIONS

English Abstract of JP 2004084098.
English Abstract of JP 8199419.
English Abstract of JP 10245712.

* cited by examiner

*Primary Examiner*—Shaun R Hurley
*Assistant Examiner*—Andrew W Sutton
(74) *Attorney, Agent, or Firm*—Dykema Gossett PLLC

(57) ABSTRACT

This invention is to obtain a targeted traveling-window channeling-off function irrelevant to respective intrinsic driving postures of a helmet wearer, a speed of vehicles and the like. Helmets A, B, C include straightening members which relate to the holding of the stability of the helmets during traveling. The straightening members are provided in a state that a position of the straightening members is adjustable in a fore-and-aft direction or an angle of straightening surfaces which face a traveling window in an opposed manner is adjustable corresponding to various intrinsic driving postures of a helmet wearer and a speed of vehicles.

7 Claims, 7 Drawing Sheets

HELMET

BACKGROUND OF THE INVENTION

1. Field of the Invention

The present invention relates to a helmet which a driver wears when he rides on various kinds of vessels and vehicles such as a motorcycle, and a automobile, a motorboat or a bicycle, and more particularly to a helmet which has a ventilation structure in the helmet and a straightening structure for channeling off a traveling wind from a surface of the helmet.

2. Description of the Related Art

As related art literature information relevant to the present invention, we note Japanese Patent Laid-Open No. 2000-328343 [Patent Document 1] and WO2002-100204 [Patent Document 2].

The constitution described in the above-mentioned Patent Document 1 is characterized in that a portion which performs the channeling-off of a traveling wind (a rear straightening member) and a portion which performs the ventilation (a passage forming member) are mounted on a surface of a helmet body as an integral structure.

Further, the constitution described in the above-mentioned Patent Document 2 is also characterized in that a portion which performs the channeling-off of a traveling wind (an air flow deflection surface) and a portion which performs the ventilation (a ventilation port) are mounted on a surface of a helmet body as an integral structure.

That is, the inventions disclosed in the above-mentioned Patent Document 1 and Patent Document 2 are useful from a viewpoint of enhancing a ventilation action and a straightening action by channeling-off the above-mentioned traveling wind.

Here, with respect to the inventions described in the above-mentioned Patent Document 1 and Patent Document 2, the portion which performs the channeling-off of the traveling wind and the portion which performs the ventilation are integrally formed and, at the same time, these portions are mounted on fixed positions on the surface of the helmet body in an immobile state. Accordingly, there may be a case that a targeted channeling function cannot be sufficiently obtained depending on the difference in intrinsic driving postures of helmet wearers, speeds of vehicles and the like.

Accordingly, it is a task of the present invention to obtain a targeted traveling-wind channel-off function irrespective of the difference in intrinsic driving postures of helmet wearers, speeds of vehicles.

SUMMARY OF THE INVENTION

To achieve the above-mentioned object, the present invention adopts following technical means.

The technical means is directed to a helmet which mounts a straightening member relating to holding of stability of the helmet against flow of air during traveling on a surface of a helmet body, wherein the straightening member is formed so as to allow a helmet wearer to adjust a position of the straightening member in a fore-and-aft direction corresponding to various intrinsic driving postures of the helmet wearer and a speed of vehicles (first invention).

Further, another technical means is directed to a helmet which mounts a straightening member relating to holding of stability of the helmet against flow of air during traveling on a surface of a helmet body, wherein the straightening member is formed so as to allow a helmet wearer to adjust an angle of a straightening surface which faces a traveling wind corresponding to various intrinsic driving postures of the helmet wearer and a speed of vehicles (second invention).

Further, still another technical means is directed to a helmet which mounts a straightening member relating to holding of stability of the helmet against flow of air during traveling on a surface of a helmet body, wherein the straightening member is formed so as to allow a helmet wearer to adjust a position of the straightening member in a fore-and-aft direction and, at the same time, to adjust an angle of a straightening surface which faces a traveling wind corresponding to various intrinsic driving postures of the helmet wearer and a speed of vehicles (third invention).

Further, when the helmet includes an air ventilation port on the surface of the helmet body, from a viewpoint of enhancing the discharge efficiency from a discharge port, it is preferable that the straightening body is capable of adjusting a relative position thereof within a range that the straightening member is capable of straightening the flow of air in the vicinity of the ventilation port (fourth invention).

When the helmet includes a ventilation cover which covers the ventilation port, from a viewpoint of the enhancement of the discharge efficiency from the ventilation cover, the enhancement of the manipulation performance and the assurance of favorable design, it is preferable that the straightening member forms an integral structure with the ventilation cover (fifth invention).

As the structure which changes the position of the straightening member, it is possible, for example, the structure which is a combination of an elongated hole which is formed along the fore-and-aft direction in one side of the straightening member or a support portion which supports the straightening member and a fitting member which is formed on another side and is fitted in the elongated hole and in which the fitting member holds the position of the straightening member and releases such holding, and the structure which forms ratchets on the straightening member and a support surface which supports the straightening member and in which the position of the straightening member is changed by moving the straightening member in the fore-and-aft direction against the fitting resistance of the ratchet.

Further, as the structure which changes the angle of the straightening member, it is possible, for example, the structure which includes an adjustment means which rotatably supports the front side of the straightening member so as to move the rear end of the straightening member vertically and holds the straightening member at predetermined position, and the structure which pivotally supports the front side of the straightening member and forms ratchets over the straightening member and a support surface which support the straightening member behind the pivotally supporting portion and moves the straightening member vertically against the fitting resistance of the ratchets so as to change the position of the straightening member.

The present invention can expect following excellent effects due to the above-mentioned constitutions.

According to the first invention, by allowing the helmet wearer to change the position of the straightening member to a position which corresponds to the various intrinsic driving postures of the helmet wearer and the speed of vehicles, it is helps to obtain the targeted traveling-wind channel-off function.

Further, according to the second invention, by allowing the helmet wearer to change the angle of the straightening member to an angle which corresponds to the various intrinsic driving postures of the helmet wearer and the speed of vehicles, it is possible to obtain the targeted traveling-wind channel-off function.

Further, according to the third invention an adjustment corresponding to various intrinsic driving postures of the helmet wearer and vehicle speed is enabled and hence helps to enhance the targeted traveling-wind channel-off function.

Further, according to the fourth invention, in addition to the acquisition of the effects of the above-mentioned first and second inventions, the straightening is conducted in the vicinity of the ventilation port for ventilation and hence, it helps to efficiently perform the discharge from the discharge port. Due to this efficient discharge, it helps to allow the traveling wind to efficiently enter the inside of the helmet through an intake port and hence, it helps to expect the efficient ventilation in the helmet.

Further, according to the fifth invention, it helps to expect the discharge efficiency from the ventilation cover, the enhancement of the manipulation performance and the favorable design.

DESCRIPTION OF THE PREFERRED EMBODIMENTS

Best modes for carrying out a helmet of the present invention are explained hereinafter in conjunction with drawings.

Figure 10:
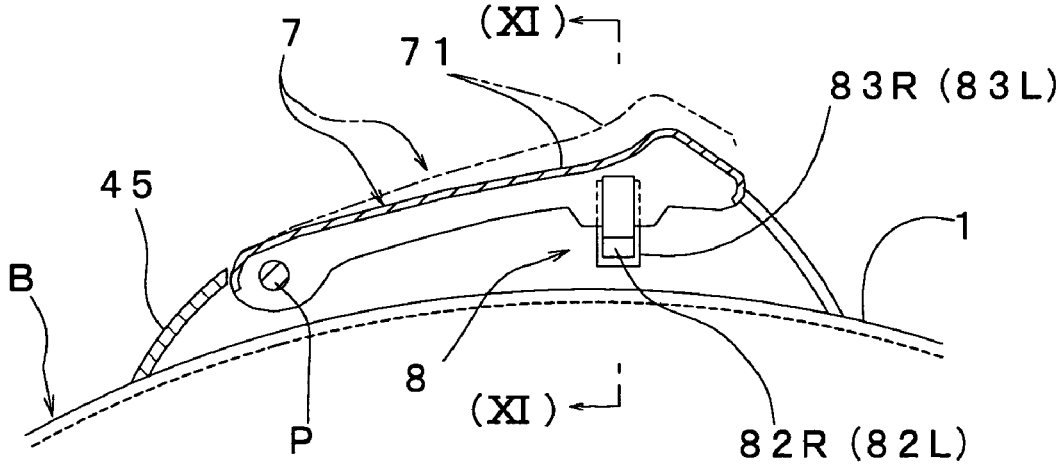
FIG. 10 is a cross-sectional view of an essential part showing another example.
Figure 11:
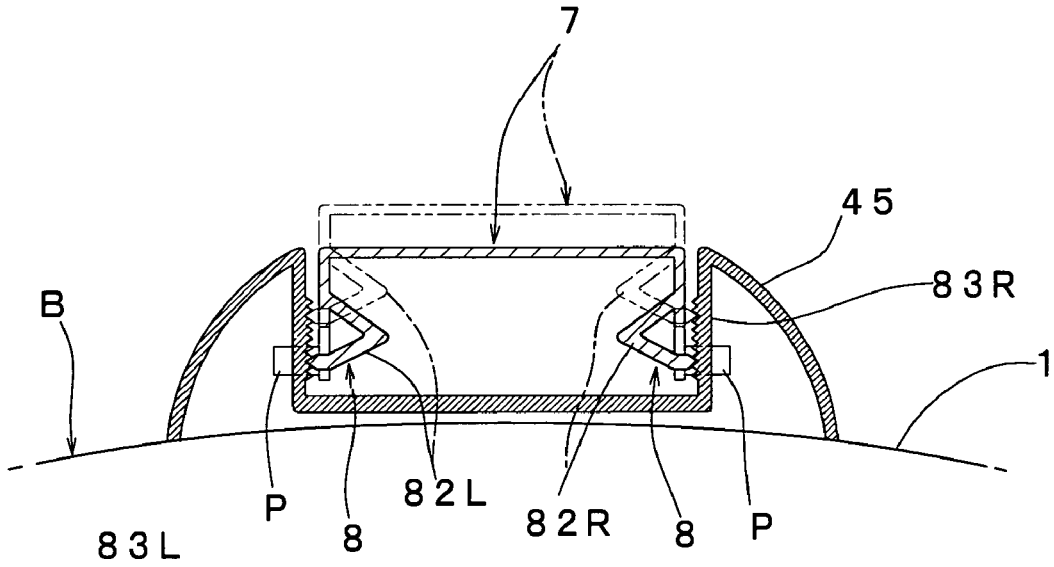
FIG. 11 is a cross-sectional view taken along a line (XI)-(XI) in FIG. 10.
Figure 12:
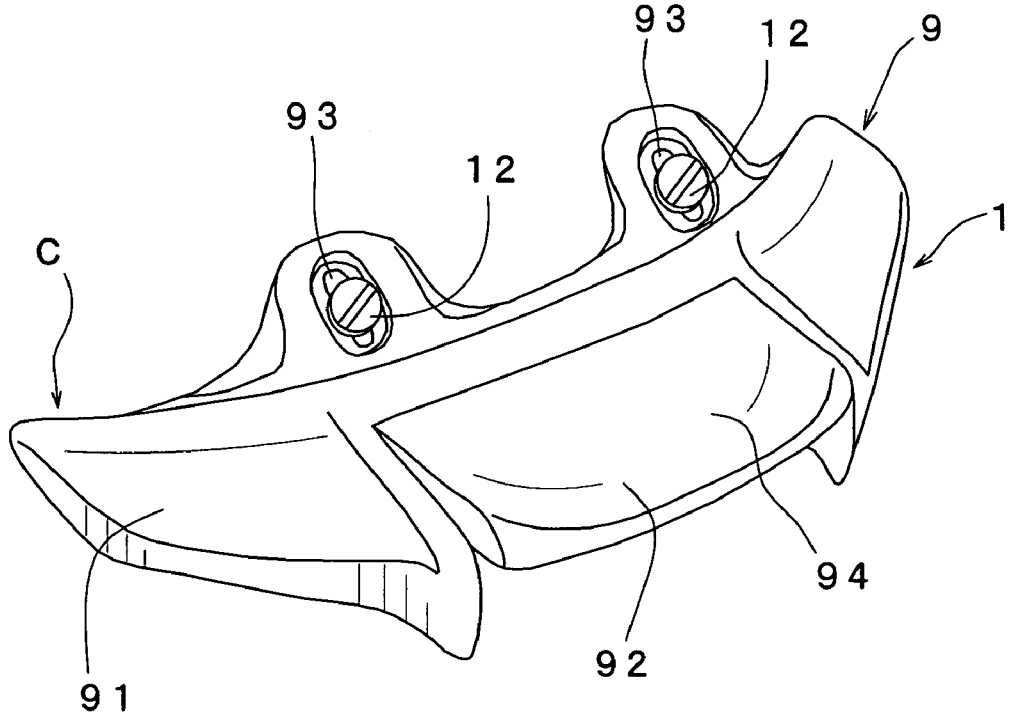
FIG. 12 is a perspective view of an essential part showing another example.
Figure 13:
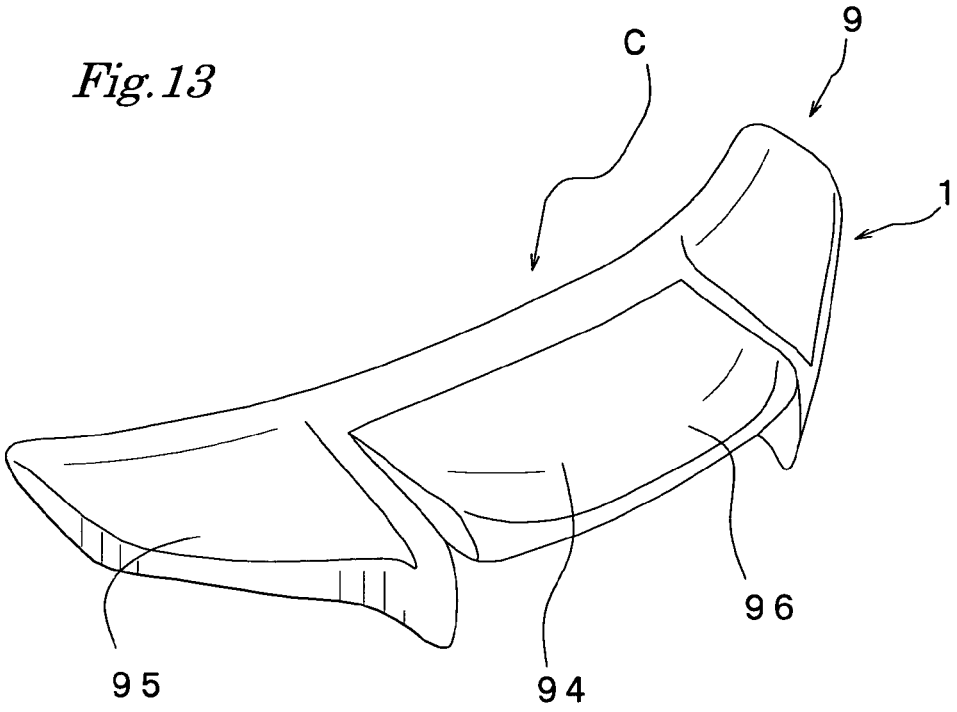
FIG. 13 is a perspective view of an essential part showing another example.

FIG. 1 to FIG. 4 show the first embodiment (helmet A) of the present invention, FIG. 5 to FIG. 11 show the second embodiment (helmet B) of the present invention, and FIG. 12 and FIG. 13 show the third embodiment (helmet C) of the present invention.

The basic construction of the helmets A to C illustrated in the respective modes is configured as follows. That is, in the inside of a helmet body 1 which is formed in a given shape using a fiber reinforced resin material, an impact absorbing liner which is formed of foamed styrene or a material having an impact absorbing function equivalent to an impact absorbing function of the foamed styrene, a head interior member which is arranged inside the impact absorbing liner and is made of a urethane material or the like, and cheek pads are interiorly formed. A shield 2 is mounted on a front opening portion of the helmet body 1 in a state that the shield 2 can be opened and closed. The helmet body is provided with two ventilation ports, that is, left and right ventilation ports 2L, 2R which discharge hot air from inside the helmets A to C.

Here, although the helmet illustrated in this mode for carrying out the invention is a full-face type helmet, the present invention is not limited to the full-face type helmet and is also applicable to a jet type helmet and a half type helmet.

First of all, the first mode of the present invention is explained.

The helmet A of this mode is characterized in that ventilation covers 3L, 3R which cover and conceal the above-mentioned ventilation ports 2L, 2R are mounted on a surface of the helmet body 1, and a position of a straightening member 4 can be changed due to the slide structure which allows the straightening member 4 to slide in the fore-and-aft direction along the ventilation covers 3L, 3R.

The ventilation covers 3L, 3R of this mode are approximately tunnel-like covers which are formed to guide a traveling wind from a front side to a rear side of the helmet body 1. Each of the respective ventilation covers 3L, 3R forms an intake port 31 in a front end thereof and an discharge port 32 in a rear end thereof. By making use of a negative pressure which is generated when the traveling wind enters the helmet A from the intake port 31 and is discharged from the discharge port 32, hot air in the inside of the helmet A is sucked from the ventilation ports 2L, 2R which are positioned inside the ventilation covers 3L, 3R.

Figure 1:
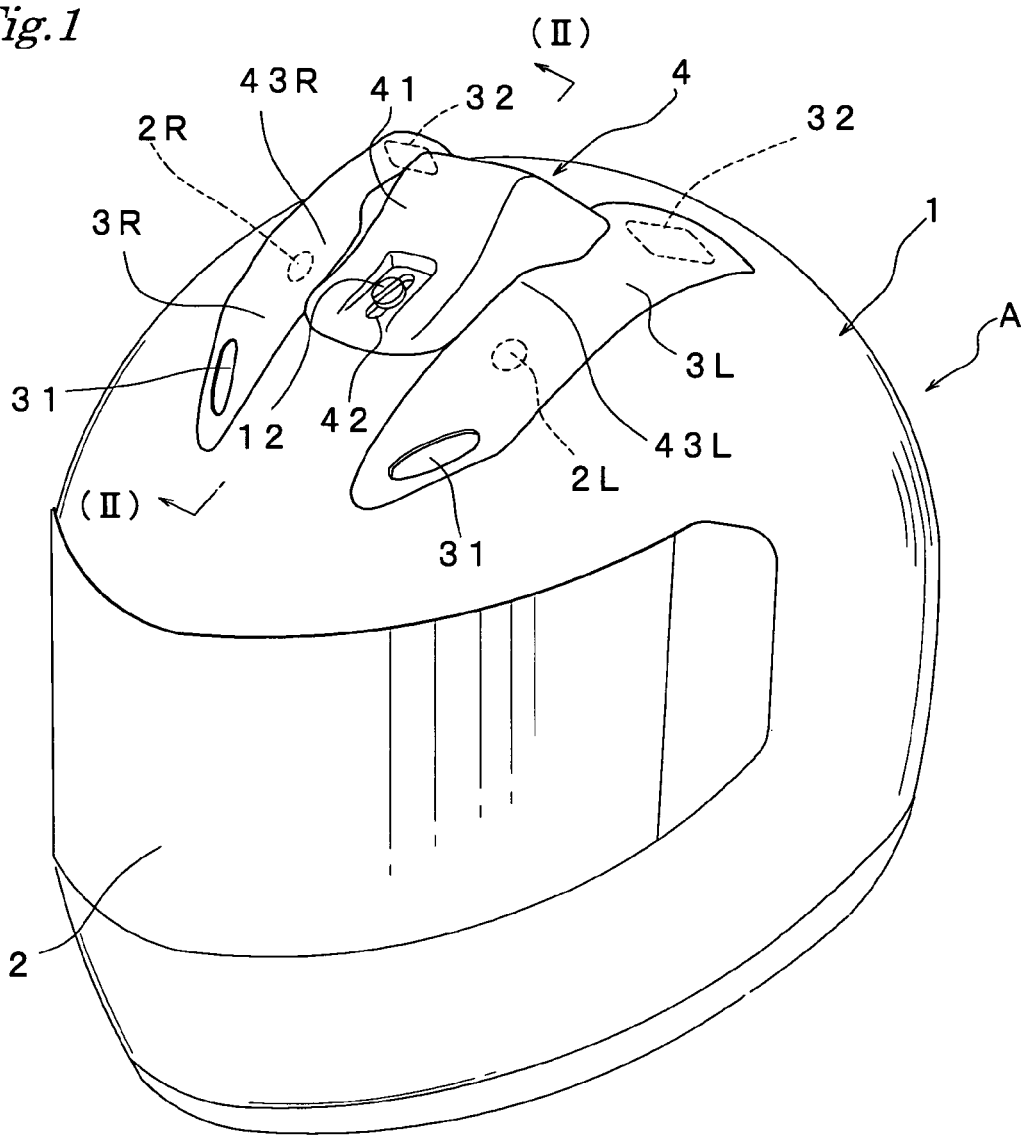
FIG. 1 is a perspective view of a helmet according to the present invention.
Figure 2:
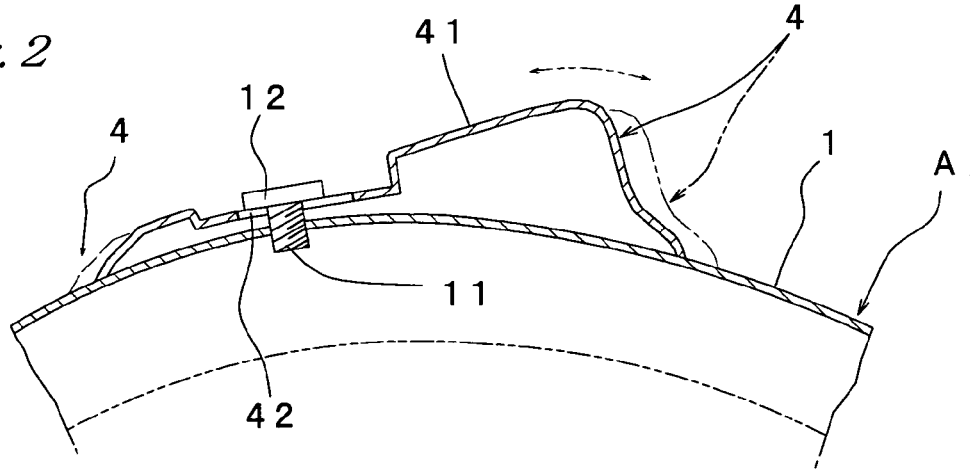
FIG. 2 is a cross-sectional view taken along a line (II)-(II) in FIG. 1.

Hereinafter, the slide structure of the above-mentioned straightening member 4 in the helmet A of this mode is explained (see FIG. 1, FIG. 2).

The above-mentioned straightening member 4 is configured such that the straightening member 4 includes an elongated hole 42 for slide guiding on a front side and a straightening surface 41 on a rear side and, further, includes slide surfaces 43L, 43R which slide while being guided by the ventilation covers 3L, 3R. The straightening member 4 is mounted on the helmet body 1 by allowing a small screw 12 which fixes the position of the straightening member 4 or releases such fixing to be threadedly engaged with a screw hole 11 formed in the surface of the helmet body 1 between the above-mentioned ventilation covers 3L, 3R through the elongated hole 42.

That is, according to the slide structure having the above-mentioned constitution, the straightening member 4 is allowed to be slidable in the fore-and-aft direction along the ventilation covers 3L, 3R by loosening or slackening the above-mentioned small bolt 12 and is held at the position by fastening the small bolt 12.

Here, the slide distance of the above-mentioned straightening member is ensured by an amount corresponding to a length of the elongated hole. The change of the slide distance can be realized by preparing the straightening members having elongated holes of different lengths and by exchanging one straightening member with another straightening member which has the targeted elongated hole (not shown in the drawing).

Figure 3:
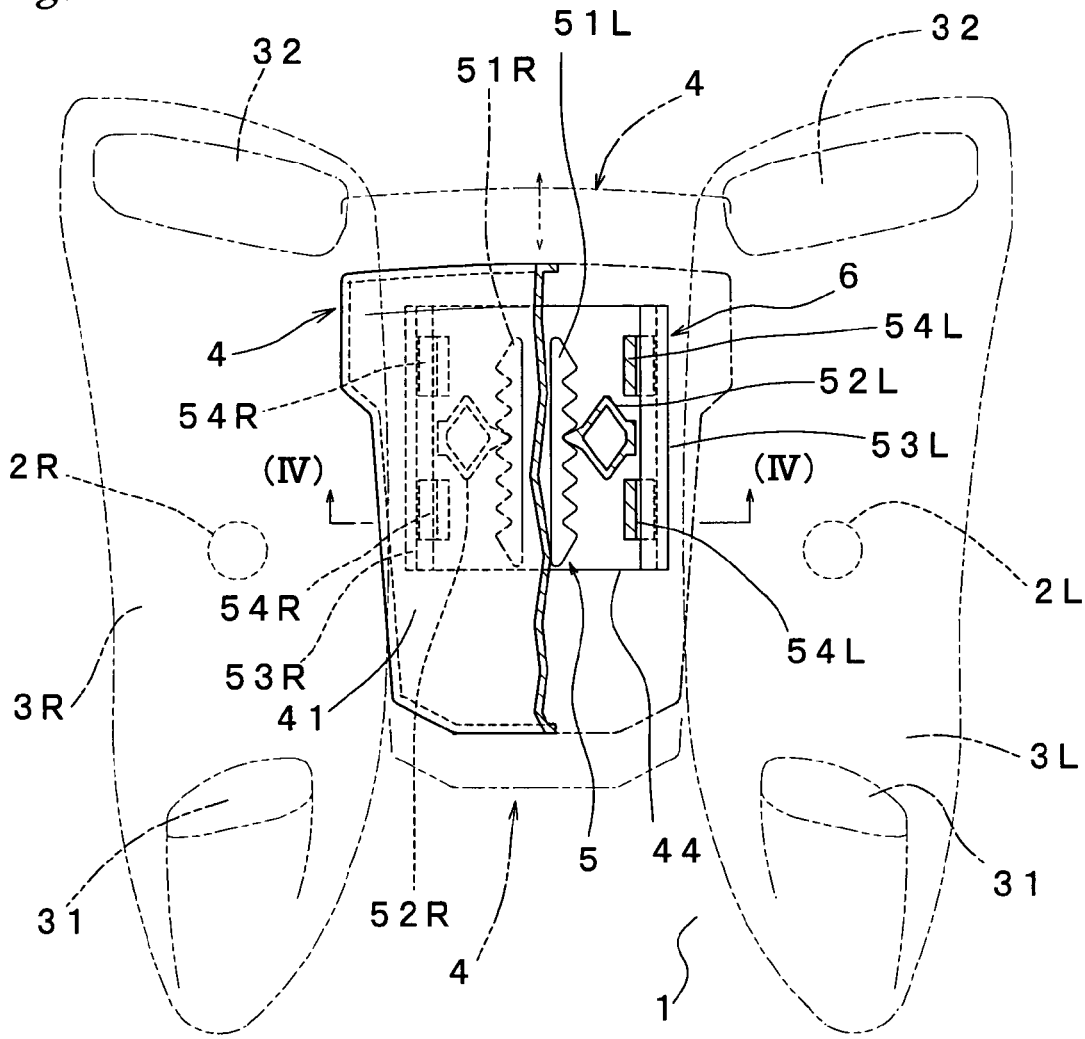
FIG. 3 is an enlarged view with a part broken away of an essential part showing another embodiment.
Figure 4:
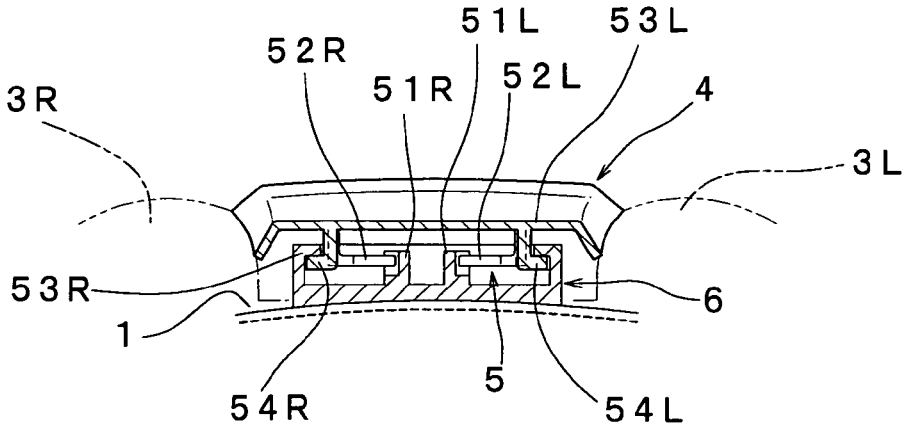
FIG. 4 is a perspective view taken along a line (IV)-(IV) in FIG. 3.

Hereinafter, another slide structure of the straightening member 4 which slides in the fore-and-aft direction is explained (see FIG. 3 and FIG. 4).

The slide structure of this mode is characterized in that the sliding and the fixing of the straightening member 4 are controlled by ratchets. The explanation of parts which overlap the above-mentioned parts is omitted by giving the same symbols to the parts.

The straightening member 4 is mounted on the helmet body 1 in a state that the straightening member 4 is mounted on a fixed plate 44 which is fixedly secured to the surface of the helmet body 1 between the above-mentioned ventilation covers 3L, 3R by way of a ratchet 5 and a slide guide portion 6 which are formed over the fixed plate 44 and the straightening member 4.

The ratchet 5 is configured such that fitting recessed portions 51L, 51R in two rows which form a large number of indentations 51 therein in the fore-and-aft direction of the above-mentioned ventilation covers 3L, 3R are mounted on the fixed plate 44 and, at the same time, resilient fitting members 52L, 52R which are engaged with or disengaged from the indentations 51 formed in either one of the above-mentioned fitting recessed portions 51L, 51R are mounted on the above-mentioned straightening member 4.

The slide guide portion 6 is configured such that latch projections 53L, 53R are mounted on the above-mentioned fixed plate 44 along the fitting recessed portions 51 L, 5 1R in a state that the latch projections 53L, 53R are arranged outside the above-mentioned fitting recessed portions 51L, 51R, while slide projections 54L, 54R which are slidably engaged with the above-mentioned latch projections 53L, 53R are mounted on the straightening member 4.

That is, according to the slide structure having the above-mentioned constitution, the position of the straightening member 4 is held by the engagement of the resilient fitting members 52L, 52R with the fitting recessed portions 51L, 51R formed in the ratchet 5, while the engagement of the resilient fitting members 52L, 52R with the fitting recessed portions 51L, 51R is released by slidably moving the straightening member 4 with a force larger than a resilient force of the ratchet 5 and the straightening member 4 is slidably moved in the fore-and-aft direction due to the slide movement of the slide projections 54L, 54R along the latch projections 53L, 53R.

Here, the slide distance of the above-mentioned straightening member is ensured by an amount corresponding to a length of the above-mentioned fitting recessed portions and latch projections. The change of the slide distance can be realized by preparing the fitting recessed portions and latch projections having different lengths and by exchanging one straightening member with another straightening member which has the targeted fitting recessed portion and latch projection (not shown in the drawing).

Further, the mode of arrangement of the constitutional members of the above-mentioned ratchet and the slide guide portion may adopt a mode which is opposite to the illustrated mode.

Further, one of constitutional members consisting of the above-mentioned ratchet and slide guide portion may be directly formed on the ventilation cover.

The second mode of the present invention is explained hereinafter.

The helmet B of this mode includes ventilation covers 3L, 3R in the same manner as the above-illustrated helmet A and also includes a straightening member 7 between the ventilation covers 3L, 3R.

Further, the straightening member 7 of this mode is configured to be capable of changing an angle of a straightening surface 71 against a traveling wind by changing an angle of the straightening member 7 by rotatably supporting the straightening member 7 using the pivotally supporting portion P as an axis.

Here, the explanation of parts which overlap the parts of the above-mentioned helmet A is omitted by giving the same symbols.

Figure 5:
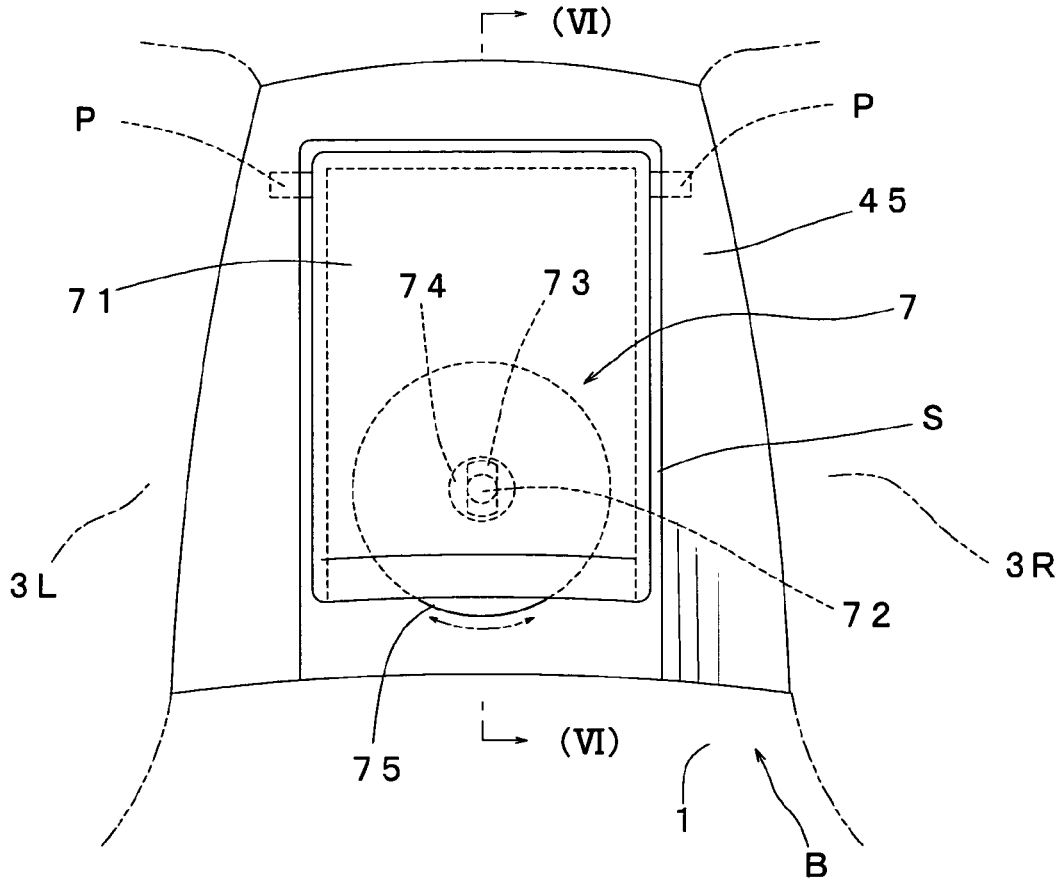
FIG. 5 is an enlarged view of an essential part showing another example.
Figure 6:
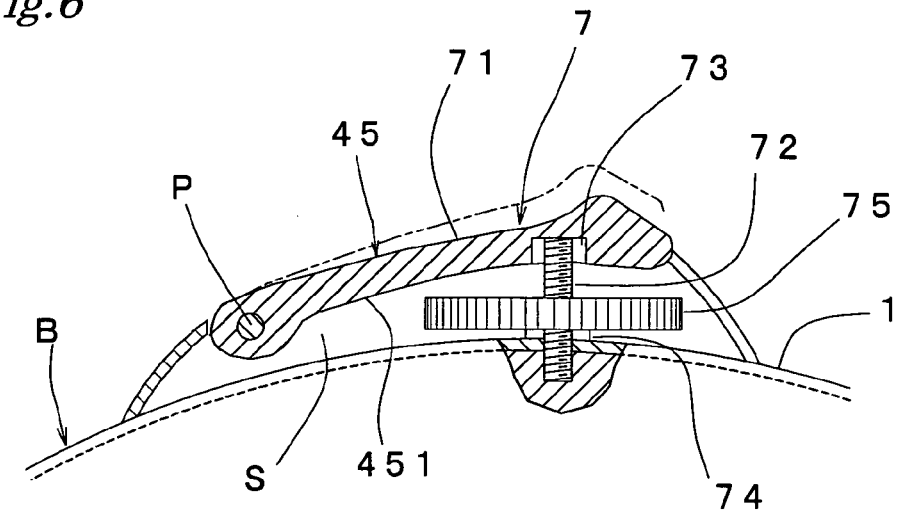
FIG. 6 is a cross-sectional view taken along a line (VI)-(VI) in FIG. 5.

The angle changing structure of the above-mentioned straightening member 4 in the helmet B of this mode is explained hereinafter (see FIG. 5 and FIG. 6).

The straightening member 7 of this mode is rotatably supported on a pivotally supporting plate 45 which is fixedly secured to the surface of the helmet body 1 between the above-mentioned ventilation covers 3L, 3R.

In the above-mentioned pivotally supporting plate 45, a space S which has a size to allow the snug fitting of the straightening member 7 is formed. The straightening member 7 is fitted in the space S and front-end-side side surfaces of the straightening member 7 are pivotally supported on front-end-side side surfaces of the space S.

Further, the above-mentioned straightening member 7 is supported on a bolt 72 which is mounted between a rear-end-side bottom surface of the straightening member 7 and a bottom surface 451 of the pivotally supporting plate 45.

The above-mentioned bolt 72 has an upper end thereof fitted in an elongated groove 73 formed in the rear-end-side bottom surface of the straightening member 7 in a state that the bolt 72 is slidable in the elongated groove 73 and is prevented from being removed from the elongated groove 73. The above-mentioned bolt 72 has a lower end thereof threaded into a pedestal portion 74 mounted on the above-mentioned helmet body 1.

The above-mentioned elongated groove 73 is provided for absorbing the displacement of the fitting position of the bolt 72 at the time of changing the angle of the straightening member 7 described later.

A dial 75 is fixedly mounted on and is disposed around the above-mentioned bolt 72. When the dial 75 is rotated, the bolt 72 is rotated and a projecting length of the bolt 72 with respect to the pedestal portion 74 is adjusted to a short length as well as to a long length.

That is, according to the angle changing structure of this mode, by elongating the projecting length of the above-mentioned bolt 72 with the rotation of the above-mentioned dial 75, a rear end portion of the straightening member 7 is lifted upwardly and the position is held.

Here, the above-mentioned straightening member 7 is rotated using the above-mentioned pivotally supporting portion P as the center of rotation so that an angle thereof is changed upwardly.

Further, by shortening the projecting length of the above-mentioned bolt 72 with the reverse rotation of the above-mentioned dial 75, the bolt 72 pulls down the rear end portion of the straightening member 7 and the position is held.

Here, the above-mentioned straightening member 7 is rotated using the above-mentioned pivotally supporting portion P as the center of rotation so that an angle thereof is changed downwardly.

Due to the above-mentioned operations, the angle of the straightening member 7 is changed and hence, it is possible to change the angle of the straightening surface 71 against the traveling wind.

Here, an angle variable range of the above-mentioned straightening member is increased or decreased corresponding to the vertical movable distance of the bolt. The change of this angle variable range can be realized by exchanging bolts which have different lengths (not shown in the drawing).

Further, the straightening member may be directly pivotally supported on the ventilation cover.

Figure 7:
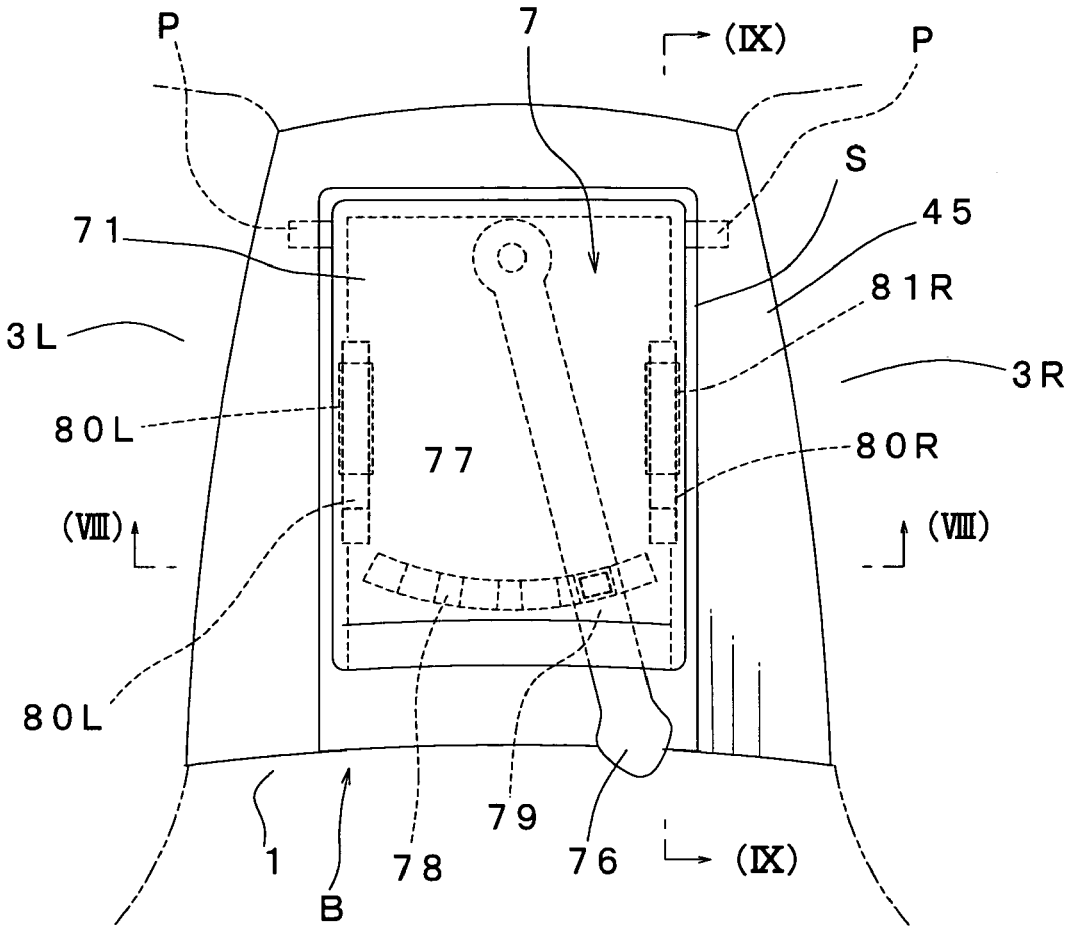
FIG. 7 is an enlarged view of an essential part showing another example.
Figure 8:
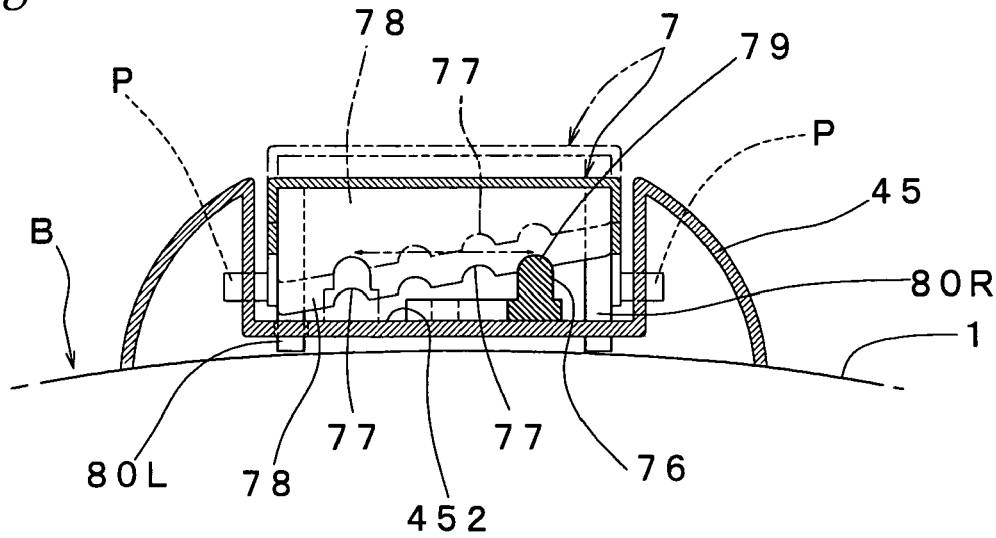
FIG. 8 is a cross-sectional view taken along a line (VIII)-(VIII) in FIG. 7.
Figure 9:
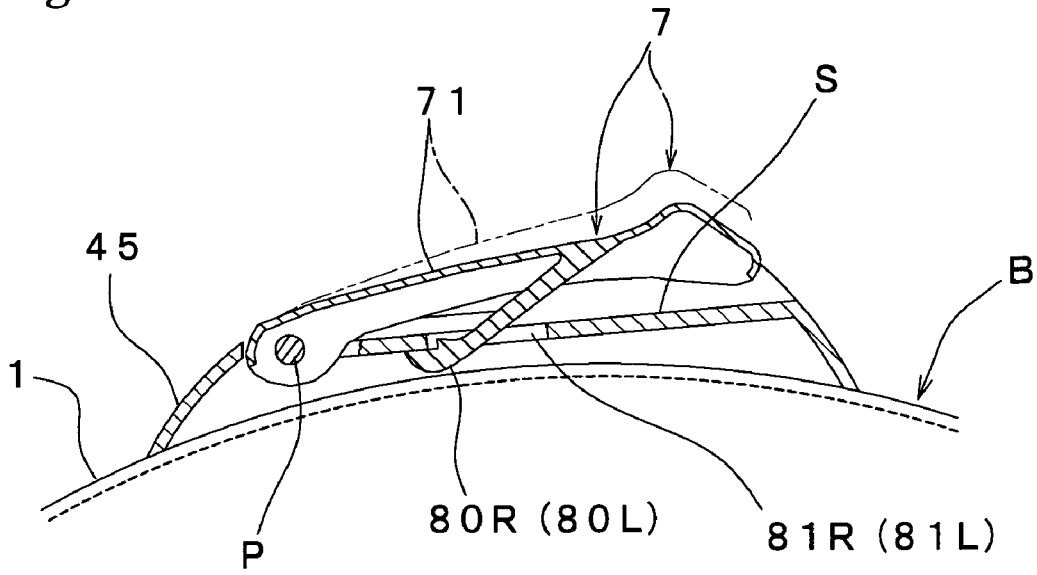
FIG. 9 is a cross-sectional view taken along a line (IX)-(IX) in FIG. 7.

Another angle changing structure of the straightening member 7 whose angle is changed is explained hereinafter (see FIG. 7 to FIG. 9).

The angle changing structure of this mode is characterized by gradually changing the angle of the straightening member 7 by a left-and-right rotational manipulation of a lever 76 and the explanation of parts which overlap the above-mentioned parts is omitted by giving the same symbols.

On a rear-end-side bottom surface of the above-mentioned straightening member 7, a recessed plate 78 is formed in a projecting manner, wherein a large number of indentation portions 77 are formed in the left-and-right direction in parallel in a state that heights of the indentation portions 77 are gradually changed in the longitudinal direction. Further, a projecting portion 79 of the above-mentioned lever 76 is configured to be fitted in any selected one of the indentation portions 77 formed on the recessed plate 78.

The above-mentioned indentation portions 77 are formed in an arcuate shape, while the projecting portion 79 is formed in an arcuate shape which conforms to the arcuate shape of the above-mentioned indentation portions 77.

The above-mentioned lever 76 is pivotally supported on a bottom surface 452 of the pivotally supporting plate 45 in a state that the lever 76 is rotatable in the left-and-right direction, wherein with the left-and-right rotating manipulation of the lever 76, the fitting position of the projecting portion 79 with respect to the above-mentioned indentation portions 77 is changed.

Symbols 80L, 80R indicate leaf springs which are fixedly secured to the straightening member 7, while symbols 81L, 81R indicate latch portions which are formed on the above-mentioned bottom surface 452 to latch the above-mentioned leaf springs 80L, 80R. By applying a biasing force of the leaf springs 80L, 80R which are latched to the latch portions 81L, 81R to the downward rotation of the straightening member 7, the fitting state of the projecting portion 79 with respect to the indentation portions 77 is held.

That is, according to the angle changing structure of this mode, the fitting position of the projecting portion with respect to the above-mentioned indentation portions 77 is changed with the left-and-right rotary manipulation of the above-mentioned lever 76, and the rear end portion of the straightening member 7 is moved vertically due to the change of the fitting position and the fitted state is held by the biasing force of the above-mentioned leaf springs 80L, 80R.

Here, the angle of the above-mentioned straightening member 7 is changed due to the rotation thereof using the above-mentioned pivotally supporting portion P as the center of rotation.

Due to the above-mentioned operations, the angle of the straightening member 7 is changed thus capable of changing the angle of the straightening surface 71 with respect to the traveling wind.

Here, although the biasing force is applied to the straightening member using leaf springs in this mode, the present invention is not limited to this mode and the present invention can be exercised also using a biasing means which possesses a substantially equal biasing force as represented by a tensile spring or rubber.

Further, an angle variable range of the above-mentioned straightening member can be widened or narrowed by adjusting a height of the above-mentioned recessed plate 78. The change of this angle variable range can be achieved by, for example, preparing straightening members having recessed plates which differ in height and by exchanging one straightening member with another straightening member which has the targeted recessed plate.

Further, the straightening member may be directly pivotally mounted on the ventilation cover.

Hereinafter, another angle changing structure of the straightening member 7 whose angle is changed is explained (see FIG. 10 and FIG. 11).

The angle changing structure of this mode is characterized by controlling the change of the angle and the fixing of the straightening member 7 using ratchets 8. The explanation of parts which overlap the above-mentioned parts is omitted by giving the same symbols.

Further, since the ratchets 8 have the substantially same constitution as the previously-illustrated ratchets 5, the detailed explanation of the ratchets 8 is omitted. The ratchets 8 are constituted of resilient fitting members 82L, 82R which are mounted on left and right side surfaces of the above-mentioned straightening member 7 and fitting recessed portions 83L, 83R which are formed on left and right side surfaces of the pivotally supporting plate 45 in a vertically extending manner.

That is, according to the angle changing structure of this mode, by vertically moving the rear end portion of the straightening member 8 with a force larger than a resilient force of the ratchets 8, the straightening member 8 is rotated in the fore-and-aft direction and hence, the angle of the straightening member 8 can be changed.

Here, the angle variable range of the above-mentioned straightening member in this embodiment can be widened or narrowed corresponding to the number of indentations formed in the fitting recessed portion. That is, the change of the angel variable range can be achieved by, for example, preparing straightening members having fitting recessed portions which differ in the number of indentations and by exchanging one straightening member with another straightening member having the targeted fitting recessed portion.

Further, the straightening member may be directly pivotally supported on the ventilation cover.

Hereinafter, the slide structure and the angle changing structure of the straightening member in the helmet C of this mode are explained (FIG. 12, FIG. 13).

In the above-mentioned helmets A, B, the straightening members 4, 7 are formed in an associated manner with the above-mentioned ventilation covers 3L, 3R. However, this mode is directed to the helmet C in which the straightening member 9 is provided independently from the above-mentioned ventilation covers 3L, 3R.

The straightening member 9 shown in FIG. 12 is constituted of a slide straightening member 91 which is provided slidably in the fore-and-aft direction with respect to the helmet body 1 and an angle changing straightening member 92 which is provided to a center portion of the slide straightening member 91 in a state that an angle of the angle changing straightening member 92 can be changed.

An elongated hole portion 93 is formed on a front side of the above-mentioned slide straightening member 91 to ensure a slide distance and a small bolt 12 is threaded into the helmet body 1 through the elongated hole portion 93. Accordingly, by loosening or slacking the small bolt 12, the slide straightening member 91 becomes slidable in the fore and aft direction.

Further, the above-mentioned angle changing straightening member 92 is configured to be rotated with respect to the slide straightening member 1 so as to change the angle of the straightening surface 94. Accordingly, with respect to the angle changing structure, the angle changing structure in the above-mentioned helmet B is applicable and hence, the illustration and the explanation of the angle changing structure are omitted.

That is, the straightening member 9 shown in FIG. 12 is characterized in that the slide straightening member 91 slides in the fore-and-aft direction with respect to the helmet body 1 so as to change the position of the straightening surface 94 and, at the same time, the angle changing straightening plate 92 is rotated to change the angle of the straightening surface 94.

The straightening member 9 shown in FIG. 13 is constituted of a fixed straightening member 95 which is fixed with respect to the helmet body 1 and an angle changing straightening member 96 which is mounted on a center portion of the fixed straightening member 95 in a state that an angle thereof can be changed.

The above-mentioned angle changing straightening member 96 is rotated with respect to the fixed straightening member 95 so as to change an angle of the straightening surface 94. Accordingly, with respect to the angle changing structure, the angle changing structure in the above-mentioned helmet B is applicable and hence, the illustration and the explanation thereof are omitted.

That is, the straightening member 9 shown in FIG. 12 is characterized in that the angle changing straightening plate 96 is rotated to change the angle of the straightening surface 94.

Figure 14:
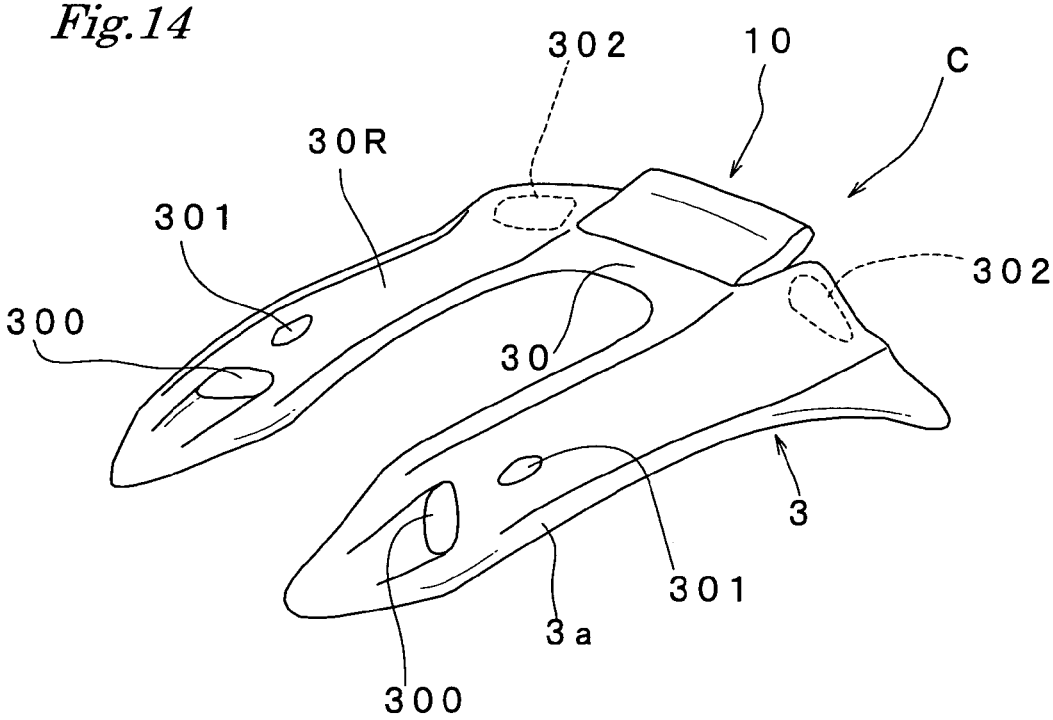
FIG. 14 is a perspective view of an essential part showing another example.

The straightening member 10 shown in FIG. 14 is characterized in that the straightening member 10 is mounted on the ventilation cover 3 in a state that the straightening member 10 is slidable in the fore-and-aft direction or an angle of the straightening member 10 is changeable.

The ventilation cover 3 of this mode is formed of an integral body which is formed by connecting left and right cover portions 30L, 30R by way of a connecting portion 30 arranged in front of a portion where the straightening member 10 is mounted.

In the drawing, numeral 300 indicates intake ports which are opened in distal ends of the cover portions 30L, 30R, numeral 301 indicates switch mechanism mounting holes which are opened in upper surfaces of the cover portions 30L, 30R to adjust an amount of air taken from the intake ports 300, and numeral 302 indicates ventilation ports which are opened in rear ends of the cover portions 30L, 30R.

According to the ventilation cover 3 of this mode, the ventilation cover 3 and the straightening member 10 are formed into a unit and hence, the efficiency of the mounting operation can be enhanced.

Further, it is possible to provide the straightening member which can adjust the angle thereof with a minimum weight without damaging a function of a conventional ventilation cover and, at the same time, it is possible to provide a sophisticated ventilation cover in terms of design.

The present invention is not limited to the illustrated modes and the present invention can be exercised with constitutions which do not depart from contents described in respective claims in the Patent Claims.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A helmet which includes a body having a first ventilation port on an outer surface thereof and a ratchet mounted thereon; a first ventilation cover which is mounted over the outer surface of the body to cover the first ventilation port, said first ventilation cover including an air intake port and an air exhaust port; and an air straightening member for stabilizing air flow over the helmet body during use, said air straightening member including fitting members which resiliently extend into indentations in said ratchet so as to be movable forwardly and rearwardly relative to the first ventilation cover with forceable repositioning of the fitting members relative to the indentations in the ratchet.

2. A helmet according to claim 1, wherein said air straightening member includes a forwardly and rearwardly-extending slot, and including a screw which extends downwardly through said slot into the body, tightening and loosening of the screw enabling the air straightening member to be moved and fixed in a forward and rearward direction.

3. A helmet according to claim 1, including a second ventilation port on the outer surface of the body and a second ventilation cover mounted over the outer surface of the body to cover the second ventilation port, the second ventilation cover including an air intake port and an air exhaust port, and wherein the air straightening member is positioned between the first and second ventilation covers.

4. A helmet which includes a body having a first ventilation port on the outer surface thereof; a first ventilation cover which is mounted over the outer surface of the body to cover the first ventilation port, said first ventilation cover including an air intake port and an air exhaust port; an air straightening member for stabilizing air flow over the helmet body during use, said air straightening member providing an air straightening surface and having a forward portion which is pivotally mounted about a generally horizontal axis; and an adjustable support means in contact with a rearward portion of the air straightening member so as to pivot the air straightening member about the pivot axis and change an angle of the air straightening surface relative to a flow of air towards the helmet.

5. A helmet according to claim 4, wherein the adjustable support means includes a bolt which extends from the body to the rearward portion of the air straightening member and a dial attached to the bolt to rotate the bolt and thereby pivot the front portion of the air straightening member about the pivot axis and raise or lower the rearward portion relative to the body.

6. A helmet according to claim 4, including a second ventilation port on the outer surface of the body and a second ventilation cover mounted over the outer surface of the body to cover the second ventilation port, the second ventilation cover including an air intake port and an air exhaust port, and wherein the air straightening member is positioned between the first and second ventilation covers.

7. A helmet which includes a body having a first ventilation port on the outer surface thereof; a first ventilation cover which is mounted over the outer surface of the body to cover the first ventilation port, said first ventilation cover including an air intake port and an air exhaust port; a second ventilation port in the outer surface of the body and a second ventilation cover over the outer surface of the body to cover the second ventilation port, the second ventilation cover including an air intake port and an air exhaust port; and an air straightening member between the first and second ventilation covers for stabilizing air flow over the helmet body during use, said air straightening member being adjustably mounted to the body so as to be forwardly and rearwardly movable relative to the first ventilation cover and so as to change an angle of a straightening surface thereof relative to a flow of air towards the helmet.

* * * * *